United States Patent [19]

Jackson, Jr.

[11] 4,103,270

[45] Jul. 25, 1978

[54] SEALING ARRANGEMENT FOR HIGH VOLTAGE FUSE

[75] Inventor: Hiram Soloman Jackson, Jr., Northbrook, Ill.

[73] Assignee: S & C Electric Company, Chicago, Ill.

[21] Appl. No.: 741,015

[22] Filed: Nov. 11, 1976

[51] Int. Cl.[2] ..... H01H 71/20

[52] U.S. Cl. ..... 337/178; 337/248

[58] Field of Search ..... 337/171, 203, 205, 217, 337/248, 178, 221

[56] References Cited

U.S. PATENT DOCUMENTS

| | | | |
|---|---|---|---|
| 2,846,544 | 8/1958 | Wood | 337/248 |
| 3,234,349 | 2/1966 | Bronikowski | 337/248 |
| 3,374,329 | 3/1968 | Bronikowski | 337/203 X |
| 3,614,700 | 10/1971 | Beard | 337/171 |

*Primary Examiner*—George Harris
*Attorney, Agent, or Firm*—Kirkland & Ellis

[57] ABSTRACT

A sealing arrangement for a high voltage fuse comprises a round metal plate that has a center portion that has been machined to reduce the thickness of the center portion. The center portion of the metal plate is then subjected to a coining or pressing operation to further reduce the thickness of the center portion and also to increase the hardness and smoothness of the center portion so that the center portion can be reliably punctured during fuse operation. The metal plate is then sealed over the end of the fuse by folding the edge of a metal conducting tube over the edge of the metal plate. The peripheral portion of the metal plate serves as a stop to prevent the expulsion of fuse parts when the fuse operates.

8 Claims, 6 Drawing Figures

SEALING ARRANGEMENT FOR HIGH VOLTAGE FUSE

BACKGROUND OF THE INVENTION

1. Field of the Invention

The present invention relates to sealing arrangements for high voltage fuses.

2. Description of the Prior Art

High voltage expulsion type fuses are well known in the art as exemplified by U.S. Pat. No. 3,267,235 — Barta and U.S. Pat. No. 3,855,563 — Cameron. Such high voltage fuses typically comprise a fusible element electrically connected between a bottom ferrule and an arcing rod in such a manner that the arcing rod moves rapidly under the urging of a spring when the fusible element melts during fuse operations. The arching rod is designed to puncture an upper sealing arrangement to trip a fuse latch to allow the expulsion fuse to drop out of its upper terminal mounting under the force of gravity. This sealing arrangement is important because the fuse is typically mounted outdoors and subjected to adverse weather conditions. If this sealing arrangement leaks, moisture can enter the fuse causing deteriorations of the interior components. The prior art sealing arrangements typically have comprised an annular ring mounted in the upper end of the fuse having an opening at the center thereof. A thin metal disk is soldered over the opening to complete the seal and to provide a thin portion for penetration by the arcing rod. The soldering operation is, of course, quite critical since an improper solder joint will result in a faulty seal.

It has been discovered that such prior art sealing arrangements are not entirely satisfactory since a reliable solder connection is difficult to manufacture and the seal is often broken during handling. Accordingly, it would be a desirable advance in the art to provide a sealing arrangement for a high voltage fuse which eliminates the deficiencies of the prior art.

BRIEF DESCRIPTION OF THE INVENTION

A sealing arrangement for high voltage fuses in accordance with the present invention comprises a circular metallic plate having a center portion reduced in thickness by machining away a central part of the material of the plate. The center portion is further reduced in thickness by a pressing or coining operation which increases the hardness and smoothness of the center portion so that the center portion can be reliably punctured by a striker pin during fuse operation to release the fuse from a fuse mounting.

Thus, it is a principal object of the present invention to provide a sealing arrangement for high voltage fuses which provides a reliable, easily fabricated seal.

A further object of the present invention is to provide a sealing arrangement for high voltage fuses which eliminates the necessity for soldering during assembly.

Yet another object of the present invention is to provide a sealing and travel-stopping arrangement for high voltage fuses which comprises a single unitary piece for both functions designed and machined in such a way as to assure reliable operation.

These and other objects, advantages, and features will hereinafter appear, and for the purposes of illustration, but not for limitation, an exemplary embodiment of the present invention is illustrated in the accompanying drawings.

DETAILED DESCRIPTION OF THE PREFERRED EMBODIMENTS

Figure 1:
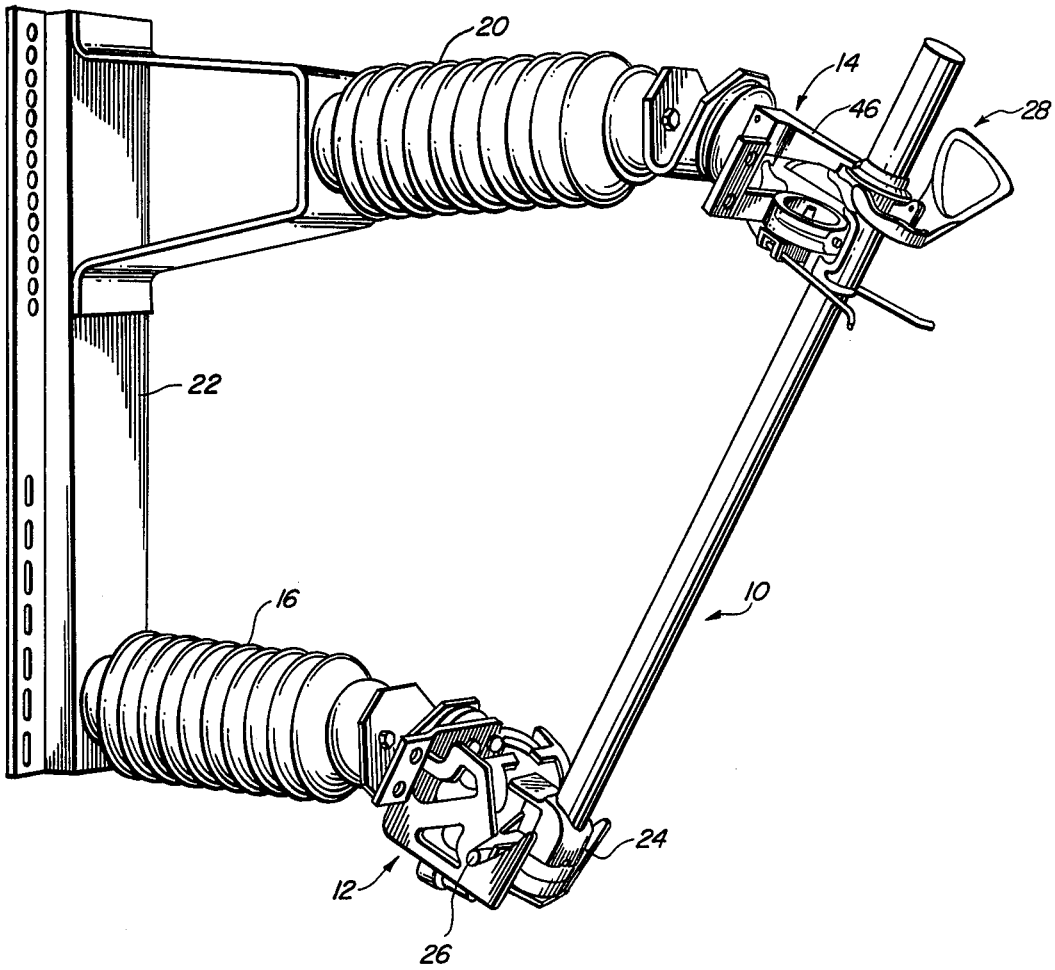
FIG. 1 is a perspective view of a typical high voltage fuse arrangement of a representative type in which the present invention may be used.

With reference to FIG. 1, a representative high voltage expulsion fuse 10 of the dropout type is illustrated mounted between a lower mounting terminal 12 and an upper mounting terminal 14. Terminals 12 and 14 are respectively mounted to one end of insulators 16 and 20 the other end of which are mounted on a supporting structure 22.

Mounting on the end of the fuse 10 is a trunnion assembly 24 having pins 26 (only one of which is shown) that engage slots on each side of lower mounting terminal 12 to pivotably support the end of the fuse 10. Mounted to the upper end of fuse 10 is a fuse release assembly 28 which cooperates with upper mounting terminal 14 to permit fuse 10 to engage and disengage upper mounting terminal 14.

Figure 2:
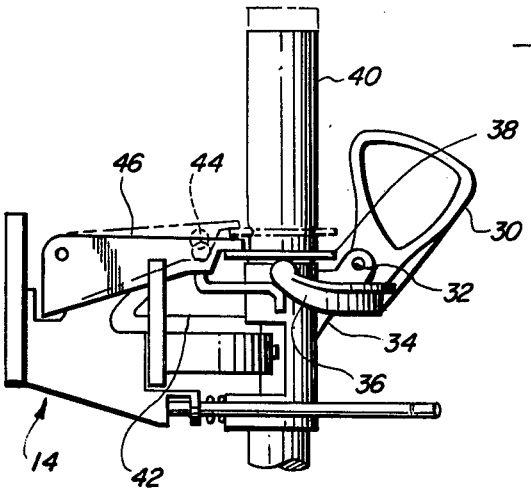
FIG. 2 is a side partially fragmentary view of the upper end of the fuse arrangement illustrated in FIG. 1.

With reference to FIGS. 1 and 2, fuse release assembly 28 comprises a hook ring 30 pivotably mounted by a pin 32 to a bracket 34. Arms 36 are connected to hook ring 30 and engage a radial flange 38 on a latch release tube 40. Fuse release assembly 28 also comprises a latch hook 42 that engages a pin 44 mounted on a latch 46 pivotably mounted on upper mounting terminal 14.

To open the circuit and remove the fuse 10 from the arrangement illustrated in FIG. 1, hook ring 30 is hooked with an insulated hook stick and pivoted around pin 32 causing arms 36 to move latch release tube 40 and radial flange 38 upwardly to the position illustrated in dotted lines in FIG. 2. In this position, radial flange 38 engages the end of latch 46 moving pin 44 upwardly until it disengages latch hook 42. Fuse 10 then can be withdrawn from the upper mounting terminal 14. Fuse 10, trunnion assembly 24 and fuse release assembly 28 are representative of many types of fuse arrangements in which the present invention could be used.

Figure 3:
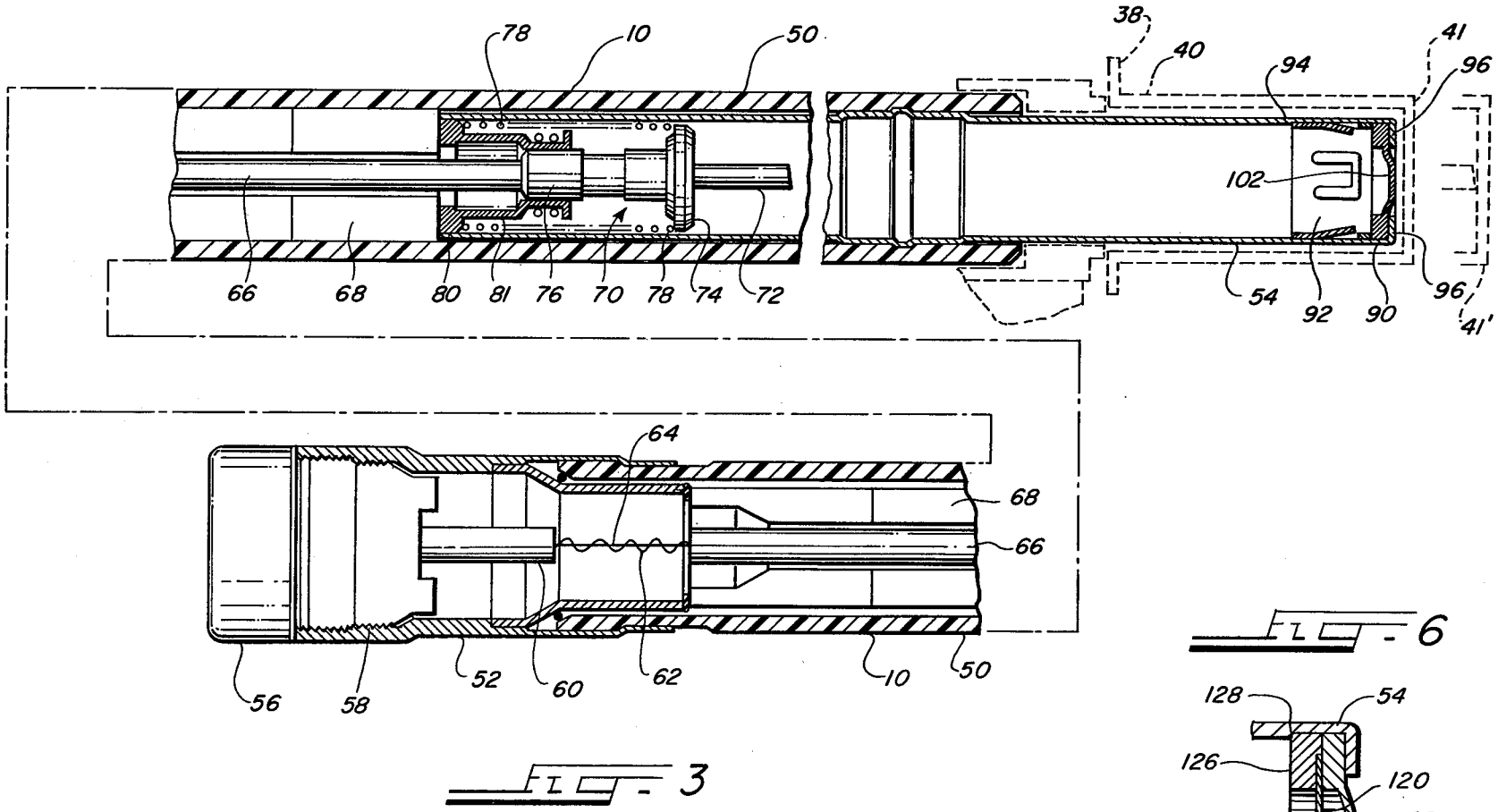
FIG. 3 is a side cross-sectional partially fragmentary view of the high voltage fuse illustrated in FIG. 1 having mounted therein a sealing arrangement in accordance with the present invention.

With reference to FIG. 3, fuse 10 comprises a hollow insulator housing 50 having a metallic ferrule 52 mounted at one end thereof and a cylindrical metallic tube 54 mounted in the other end thereof. Mounted over the end of ferrule 52 is a rain cap assembly 56. Rain cap assembly 56 does not form a part of the present invention and is the the subject of a separate co-pending application Ser. No. 741,023, filed Nov. 11, 1975, now U.S. Pat. No. 4,047,142 and assigned to the same assignee as the present application.

Threaded into the interior of ferrule 52 is a contact bridge 58 having a column shaped element 60 mounted thereon and extending therefrom. Connected to the end of element 60 is a fusible element 62 which may be fabricated from a silver alloy and a strain wire 64 which may be fabricated from high strength material such as nickel chromium alloy. The other end of the fusible element 60 and strain wire 64 are connected to an arcing rod 66 which is positioned in and extends through a hollow opening through a stack of cakes of arc extinguishing material 68. Mounted on the end of arcing rod 66 is contact button assembly 70 which includes a striker pin 72, a button flange 74, and a contact portion 76. A spring 78 in compressed between the edge of buttom flange 74, and an annular flange 80 on contact assembly 81 mounted within the end of tube 54. Thus, compressive spring bias force is exerted against button flange 74 tending to urge arcing rod 66 and contact button assembly 70 toward the right as viewed in FIG. 3. However, strain wire 64 prevents arcing rod 66 from moving. As can be seen, as long as strain wire 64 and fusible element 62 remain intact, the arcing rod and contact button assembly remain in the position illustrated in FIG. 3. When fusible element 62 and strain wire 64 melt as a result of fuse operation, spring 78 is released causing arcing rod 66 and contact button assembly 70 to be rapidly moved through the interior of tube 54.

Mounted in the end of tube 54 is seal 90 which is dimensioned to just fit within the interior of tube 54. Seal 90 rests against an annular shaped catcher element 92 which is also dimensioned to just fit within the interior of tube 54. The end of tube 54 is counterbored slightly so that there is a small shoulder 94 within the interior of tube 54 against which the edge of catcher element 92 rests so that catcher element 92 will not slide down through tube 54. The seal 90 engages the other edge of catcher element 92 and is retained in position by the folding of edge 96 of tube 54 over seal 90.

Figure 5:
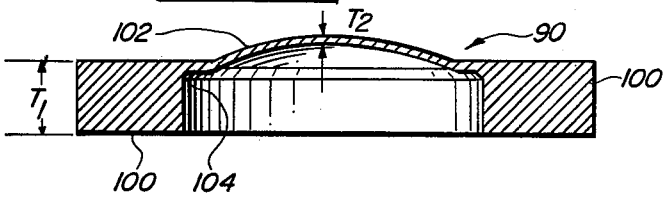
FIG. 5 is a cross-sectional view of the sealing arrangement of the present invention after a coining operation has been performed.

With reference to FIG. 5, an enlarged cross-sectional view of seal 90 is illustrated. Seal 90 essentially comprises a ring-shaped portion 100 which has a first thickness T1. Integrally formed across the center of ring-shaped portion 100 is a second circular portion 102 which has a thickness T2 which is substantially less than thickness T1. The second circular portion is integrally formed to the ring-shaped portion 100 along the peripheral edge of ring-shaped portion 102.

Figure 4:
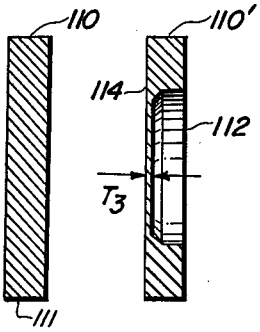
FIG. 4 is a cross-sectional view of the sealing arrangement in accordance with the present invention during fabrication thereof.

The method of fabricating of seal 90 is particularly illustrated in FIGS. 4 and 5. With reference to FIG. 4, seal 90 originally comprises a round metallic plate 110 having an essentially rectangular cross section. Plate 110 is then subjected to a machining operation to remove a portion of the center of the plate until the central portion 112 is substantially thinner than the remainder of the plate 110', and has a thickness of approximately T3 as illustrated in FIG. 4. It will be noted that the thinned central portion 112 of machined round metallic plate 110' in FIG. 4 is essentially flat lying in the same plane as the surface 114 of plate 110'. Dimension T3 of plate 110' is a dimension which is still thick enough to permit convenient machining so that the machined tool will not puncture or tear center portion 112.

Plate 110' is then subjected to a coining operation so that the center portion 112 of plate 110' is pressed by specially designed tooling so that center portion 112 takes the form of second circular portion 102 in FIG. 5 with a curved surface and a dimension T2 which is less than the dimension T3. This coining or pressing operation reduces the thickness from a dimension T3 to a dimension T2 while also increasing the smoothness and the hardness of the center portion.

The purpose for the seal 90 will be more readily understood with respect to FIG. 3. As previously pointed out, fuses such as fuse 10 are typically hermetically sealed to prevent the admittance of moisture to the interior thereof. However, when a dropout fuse of the type illustrated in FIG. 1 operates, it is necessary for the fuse to be disconnected from its upper terminal mounting so that it can "dropout" of the circuit to visually indicate that the fuse has operated.

As previously described with respect to FIG. 2, when latch release tube 40 moves upwardly to the position illustrated by the dotted lines in FIG. 2, the radial flange 38 engages the end of latch 46 causing the latch 46 to pivot to the position illustrated by the dotted lines so that pin 44 disengages the edge of latch hook 42 and fuse 10 can drop out of the circuit.

With reference to FIG. 3, latch release tube 40 is shown in dotted lines. As previously pointed out, when strain wire 64 and fusible element 62 melt during fuse operation, spring 78 causes arcing rod 66 and contact button assembly 70 to be rapidly moved through the interior of tube 54 towards the end of tube 54 where seal 90 is positioned. Striker pin 72 is designed to strike and penetrate second circular portion 102 so that the end of striker pin 72 engages the end wall 41 of latch release tube 40 causing latch release tube 40 to move until end wall 41 reaches the position designated by the numeral 41' in FIG. 3. This causes the radial flange 38 to move upwardly to the position illustrated by dotted lines in FIG. 2 so that fuse release assembly 28 releases the fuse from the upper mounting terminal 14. The fuse 10 can then pivot around pin 26 and dropout of the circuit under the force of gravity thereby providing a visual indication of fuse operation.

Thus, it can be seen that the second central portion 102 of seal 90 must first provide a reliable seal against the admittance of moisture, but also be sufficiently thin to permit reliable penetration by striker pin 72 so that the fuse will properly be released from its upper mounting terminal during fuse operation. If central portion 102 is too thick, pin 72 may not penetrate sufficiently to move the latch release tube 40 far enough to allow the fuse to be released from its upper terminal. If central portion 102 is too thin, it may be accidentally punctured by handling during shipment and installation. Further, since central portion 102 is integrally formed to the ring-shaped portion 100 of seal 90, a very reliable moisture imprevious seal is provided since there is no possibility for a faulty solder junction as has been experienced in the prior art seals.

Further, the coining or pressing operation previously described assures that the thickness of the second circular portion 102 will be of a standard thickness thereby helping to assure reliable fuse operation. Moreover, the pressing operation which is a cold working operation increases the hardness of the central portion thereby assisting in the penetration by striker rod 72 by reducing the ductility of the metal. This work hardening of the second central portion also helps to protect the seal from inadvertent damage during handling. Moreover, the coining operation has advantages since it is very difficult, if not impossible, to machine the second circular portion 102 to the desired dimension by conventional machining operations since the dimension T2 is so thin that the typical machine tool will snag causing the central portion to be punctured before the dimension T2 can be reached. However, by machining the round metallic plate 110 to a dimension T3 which is sufficiently thick to be conveniently machined, and then subjecting the center portion 112 to the coining operation, the thickness T2 can be achieved reliably without puncture. Dimension T1 is selected to be thick enough to reliably stop the movement of arcing rod 66 when button flange 74 strikes the ring shaped portion 100 without cracking or breaking so that the arcing rod 66 is not expelled from the top of the fuse even during interruption of high currents.

Figure 6:
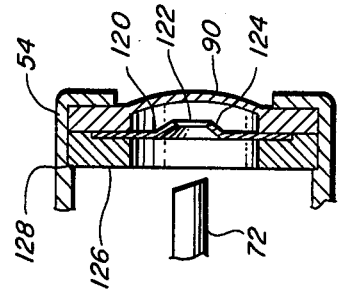
FIG. 6 is a cross-sectional view of another embodiment of the present invention.

FIG. 6 shows another embodiment of the present invention. Seal 90 is substantially the same as that previously illustrated. The principal difference resides in the utilization of an annular catcher member 120 which has a central opening 122 therethrough and flanges 124 formed at an angle so that when striker pin 72 moves through tube 54 it will move through opening 122 before it penetrates seal 90. The catcher 120 is held in position by an annular ring 126 which engages a machined flange 128 on the interior of tube 54. The purpose of catcher 120 is to prevent striker rod 72 and contact button assembly 70 from rebounding or bouncing back after fuse operation so that striker pin 72 remains fully extended through central portion 102 after penetration. If striker pin 72 bounces back or rebounds rapidly, it is possible that latch 46 will not disengage from latch hook 42 for a sufficient length of time to allow the gravitational forces to cause fuse 10 to drop out of its upper mounting terminal 14. Thus, it is desirable for contact button assembly and striker pin 72 to be retained at the extreme end of tube 54 after fuse operation so that it is assured that the fuse release assembly 28 will operate to release the fuse and so that the operated fuse cannot be closed back into the circuit after fuse operation. The flanges 124 around the opening 122 serve to grip striker pin 72 after it has moved through the opening 122 so that the striker pin 72 cannot move back through opening 122 after it has once penetrated that opening. The catcher 120 operates much like conventional pushnuts which are typically used to assemble children's toys as well as other industrial uses.

It should be understood that the sealing arrangement 90 can be used in combination with a variety of different types of high voltage fuses and it is not intended that seal 90 be limited to use only in connection with a fuse 10 as illustrated in FIG. 3. Further, it should be apparent to one skilled in the art that various alterations, modifications, or changes in the preferred embodiment illustrated herein may be effected without departing from the spirit and scope of the present invention as defined in the appended claims.

I claim:

1. In a high voltage fuse of the type having a moveable spring biased arcing rod with a striker pin on the end of the arcing rod, an improved sealing arrangement comprising a round metal plate mounted at one end of the fuse, said metal plate having a round annular outer portion and a center portion machined to reduce the thickness of the center portion, said center portion having been subjected to a pressing operation to further reduce the thickness of said center portion and to also increase the hardness and smoothness of said center portion so that said center portion can be reliably punctured by the striker pin during fuse operation.

2. In a high voltage fuse including a hollow cylindrical housing, a first ferrule mounted at a first end of the housing, a fusible element connected at one end to the first ferrule, a moveable arcing rod connected to the other end of the fusible element, a spring biasing the arcing rod for movement away from the fusible element so that the arcing rod will move rapidly toward a second end of the housing when the fusible element melts, a striker pin on the end of the arcing rod capable of engaging a fuse mechanism at the second end of the housing to cause the fuse mechanism to operate when the rod moves under the urging of the spring; an improved sealing arrangement comprising:

a metallic member sealed over the second end of the housing, said metallic member having a first ring-shaped portion of a first thickness and a second circular portion of a second thickness, said ring portion surrounding said circular portion and integrally joined thereto, said second thickness being thin enough to permit the striker pin to puncture said second circular portion when the spring moves the arcing rod so that the fuse mechanism will operate.

3. An improvement as claimed in claim 2, wherein said first thickness of first ring shaped portion is sufficiently thick to stop movement of said arcing rod and retain said arcing rod within the fuse during fuse operation.

4. An improvement, as claimed in claim 2, wherein said second portion is subjected to a pressing operation so that the thickness of said circular portion is reduced while the smoothness and hardness of said center portion is increased.

5. An improvement, as claimed in claim 2, wherein said metallic member is sealed over the second end of the housing by folding an edge of a metallic conducting tube mounted in the second end of the housing over the periphery of said first ring-shaped portion.

6. An improvement, as claimed in claim 2, further comprising an annular member mounted adjacent said metallic member, said annular member having an opening at the center thereof and flange means positioned around said opening, said flange means adapted to engage the striker pin when the arcing rod moves to the second end of the fuse housing during fuse operation so that the arcing rod and striker pin cannot move back away from the second end of the fuse and the striker pin remains entended through said metallic member.

7. An improvement, as claimed in claim 6, wherein said flange means comprise a plurality of flanges defining said opening, said flanges being slanted at an angle in the direction the stricker pin moves during fuse operation.

8. A sealing arrangement to be used for sealing the end of a high voltage fuse of the type having a moveable fuse part comprising:

a circular metallic plate having a center portion reduced in thickness by removing a central part of the material of the plate so that a thicker outer ring shaped portion and a thinner center portion is formed, said center portion being further reduced in thickness by a pressing operation so that the hardness and smoothness of said center portion is increased so that the center portion can be reliably punctured by the moveable fuse part.

* * * * *

UNITED STATES PATENT AND TRADEMARK OFFICE

CERTIFICATE OF CORRECTION

PATENT NO. : 4,103,270

DATED : July 25, 1978

INVENTOR(S) : H. S. Jackson, Jr.

It is certified that error appears in the above-identified patent and that said Letters Patent are hereby corrected as shown below:

Column 1, line 17, "arching" should read "arcing".
Column 2, line 63, the word "the" in the second instance should be deleted.
Column 3, line 12, "in" should read "is".
Column 3, line 13, "buttom" should read "button".

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*